United States Patent [19]

Hengartner et al.

[11] 4,216,915

[45] Aug. 12, 1980

[54] ELECTROSTATIC POWDER SPRAY GUN

[76] Inventors: Alex Hengartner, Friedtalweg 13, Wil; Peter Wachter, Segantinistrasse 42, St. Gallen; Kurt Baumann, Junkerstrasse 24, Wil, all of Switzerland

[21] Appl. No.: 897,110

[22] Filed: Apr. 17, 1978

[30] Foreign Application Priority Data

May 12, 1977 [CH] Switzerland ..... 5953/77

[51] Int. Cl.[2] ..... B05B 5/02

[52] U.S. Cl. ..... 239/698; 239/73; 239/74; 239/505

[58] Field of Search ..... 239/697, 698, 704, 706, 239/514, 73, 74, 505, 506; 251/133

[56] References Cited

U.S. PATENT DOCUMENTS

| | | | |
|---|---|---|---|
| 2,354,573 | 7/1944 | Brock | 251/133 |
| 2,816,800 | 12/1957 | Russell | 239/73 |
| 3,008,645 | 11/1961 | Morel et al. | 239/706 |
| 3,608,823 | 9/1971 | Buschor | 239/698 |
| 4,088,268 | 5/1978 | Vöhringer | 239/701 |
| 4,169,560 | 10/1979 | Vöhringer | 239/698 |

*Primary Examiner*—Bruce H. Stoner, Jr.
*Assistant Examiner*—Michael J. Forman
*Attorney, Agent, or Firm*—Frishauf, Holtz, Goodman & Woodward

[57] ABSTRACT

The disclosed gun is of the type having a housing with a nozzle and a deflecting plate spaced from the muzzle and mounted on a rod axially guided in the muzzle, the annular channel formed between the muzzle and the rod serving as a powder channel. Electrodes extend into the powder channel and are connected to a high voltage source. A stepping motor is connected to the rod to change its axial position, and control means are connected to the motor. Digital circuits inside the housing and manually operable switches permit automatic control or manual control from the gun of the deflecting plate spacing, the voltage, and the powder feed. Indicating means on the gun display the values of the controlled parameters.

8 Claims, 2 Drawing Figures

ELECTROSTATIC POWDER SPRAY GUN

The present invention relates to a powder spray gun for electrostatic powder coating of surfaces to color pigment them. The electrostatic powder coating, especially color pigmenting, of surfaces of machines, devices, building elements, and the like for creating protective layers is of increasing importance.

BACKGROUND AND PRIOR ART

A powder spray gun, is usually used for powder coating, which is part of an apparatus including a control unit and a supply reservoir for the powder. The control unit permits manual voltage regulation of the high voltage generator of the gun by adjustment of a potentiometer, with the electrodes of the high voltage generator extending into the powder stream passageway in the gun and electrostatically charging the powder. The control unit further permits a manual regulation of the powder amount which the gun passes within a given time period. In front of the muzzle of the gun there is a deflection plate, which has the effect of deflecting and scattering the powder stream exiting from the gun muzzle, the spacing of the deflection plate from the gun muzzle determining the degree of deflection and scattering of the powder.

The use of presently available apparatus often is not economically feasible. For adjustment of the spacing of the deflection plate from the gun muzzle, the equipment must be shut off in order to permit the adjustment to be made manually. Furthermore, the regulation of the needed powder feeds and of the voltage of the generator is awkward, since each time there must be manual adjustment of the control unit, which can at times be relatively remote from the location where the gun is being operated.

SUMMARY OF THE INVENTION

Briefly the deflection plate is fed to a rod which is guided and axially movable in the muzzle. The rod is connected through drive means to a servo-motor controlled by a control unit. Housed in the gun housing are display means and manually operable pressure switches for the control of the servo-motor as well as for the regulation of the high voltage and the powder feed directly from the gun.

Through these measures it is now possible, aside from the control of all functions, namely the deflection plate adjustment, the powder feed regulation, and the regulation of the high voltage from the control device, to undertake all these functions directly from the gun without the necessity of interrupting the working process of the gun. This permits a continuing adaptation of the parameters to changed requirements during operation.

It is readily feasible to send back to the control unit through control return leads, and to record, the newly adjusted values, in order that for later similar working conditions they can be automatically set by the control unit.

In a preferred embodiment of the invention, the powder spray gun can be further designed so that the drive means include a threaded plug driven by the motor shaft and engaging internal threads inside the inner end portion of the deflection plate rod.

The apparatus is preferably so arranged to have at least one control unit for the operation of one or more powder spray guns, with a powder supply reservoir being connected between the control unit and the gun.

DESCRIPTION OF THE PREFERRED EMBODIMENT

Figure 1:
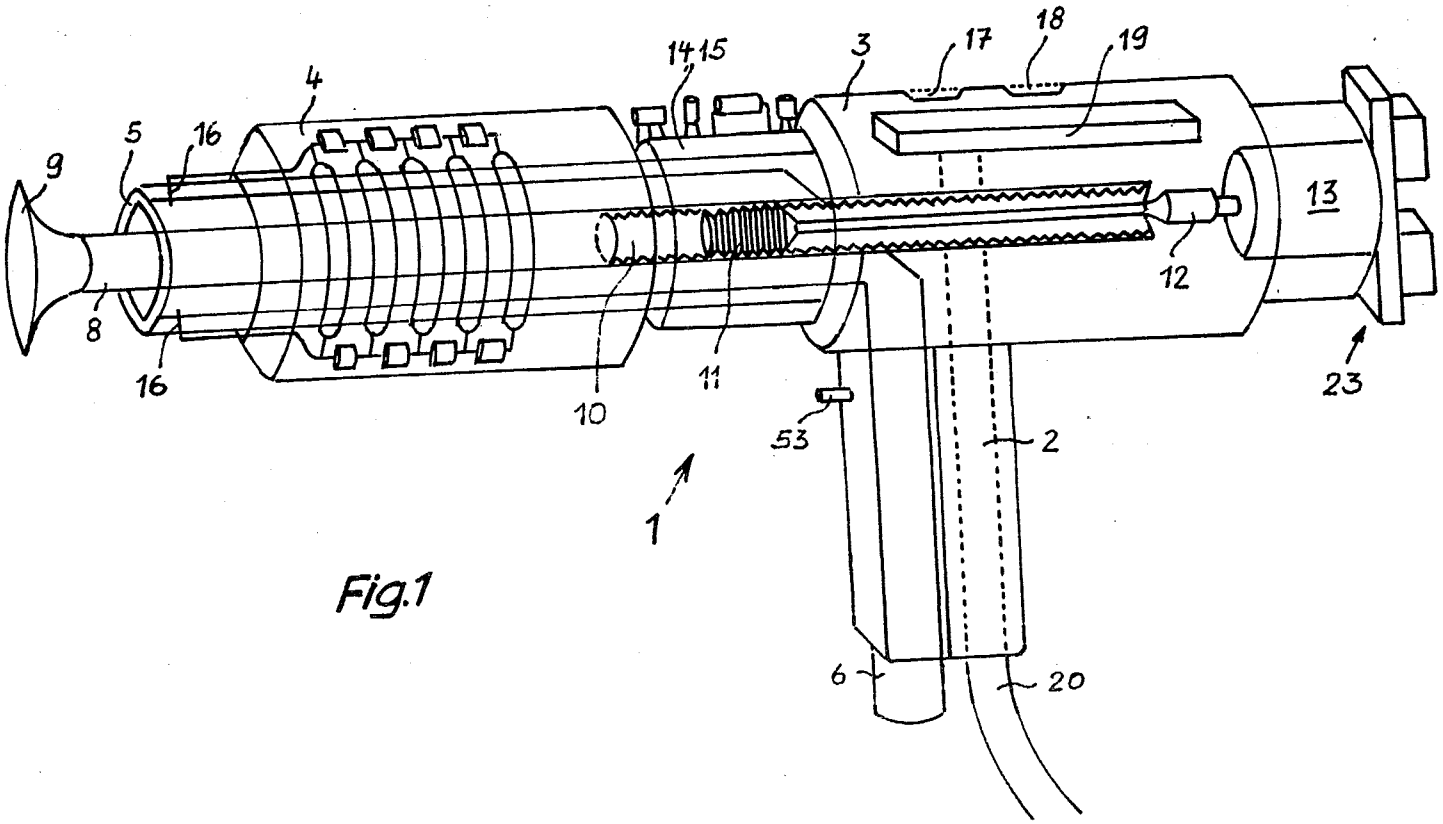
FIG. 1 is a schematic representation of a powder spray gun in accordance with a preferred embodiment of the present invention.
Figure 2:
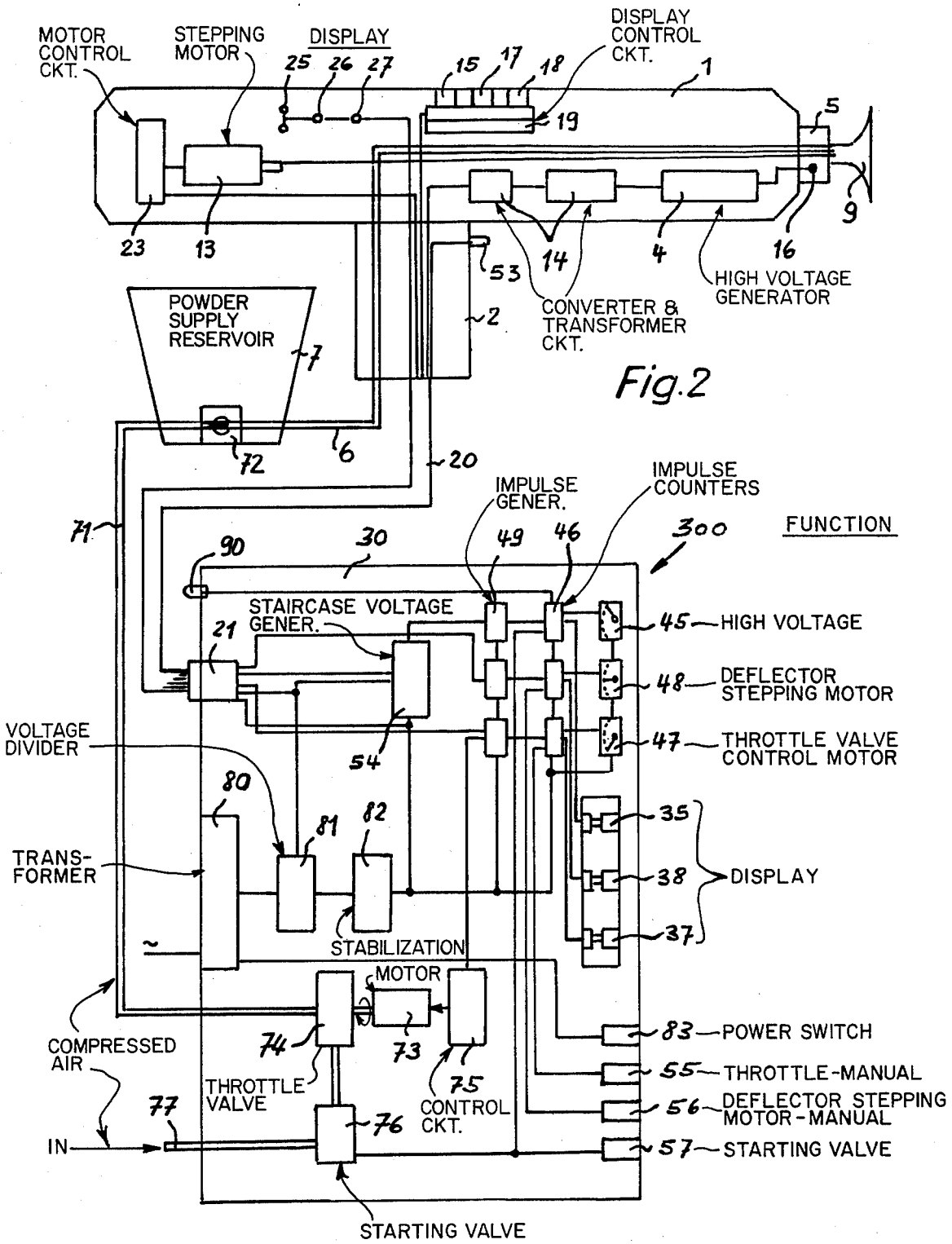
FIG. 2 is a graphical representation in block-diagram form of a complete apparatus, including a control unit, a powder supply reservoir, and the powder spray gun of FIG. 1, and in which the functions of the respective control elements are also listed.

The powder spray gun 1 shown in FIG. 1 has an electrically insulating hand grip 2 and housing 3, and a muzzle tube 5 defining a powder channel at least partially electrically insulating and with a portion surrounded by the windings of a high voltage generator 4. Inside the housing 3, the muzzle tube 5 is joined to a supply line 6 which enters the hand grip 2 from a powder supply reservoir 7 (FIG. 2). Axially disposed in the muzzle tube 5 is a rod 8 of a deflecting plate 9 which has an adjustable spacing from the muzzle. The inner end portion of the rod 8 is internally threaded and is engaged internally by a threaded plug 11. The threaded plug 11 is connected toward the rear end of the gun 1 to the shaft 12 of a stepping servo-motor 13. A control circuit 23 for the servo-motor 13 is provided. As may be readily seen, the rotation of the motor shaft 12 in one or the other direction results in an axial displacement of the rod 8 and hence the deflecting plate 9, through which the spacing between the deflecting plate 9 and the muzzle of the gun may be changed, with such changing effecting in known ways the degree of deflecting and scattering of the powder stream sent out from the muzzle. The rod 8 is axially adjustably guided inside the gun body 3 in a manner not shown in further detail.

It can also be seen that connected to the output of the high voltage generator 4 and on the gun 1 is a converter-transformer circuit 14 with display means 15 (FIG. 2), not further described, for displaying the voltage between electrodes 16 which extend into the powder stream passageway ending at the gun muzzle.

Next to the display 15 for the high voltage, there are further provided display means 17 for the supplied powder amount as well as display means 18 for displaying the instantaneous position of the deflecting plate 9 relative to the muzzle of the gun. The control circuits for these are indicated by 19 and not further described.

The display circuits 19, the display means 15 of the converter-transformer circuit 14, and the control circuit 23 for the motor 13 are connected to the control unit 30 by a coaxial cable 20 which has a connector 21 (FIG. 2) and which passes through the gun grip 2.

The control unit 30 includes, a circuit for supplying and regulating the quantity of powder to be taken from the reservoir 7. A starting valve 76 is connected to a compressed air line 77. The starting valve 76 actuates a throttle valve 74 in response to a starting signal. A motor 73, which is preferably a stepping motor, regulates in accordance with its control from its control circuit 75 the amount of pressurized air through the line 71 to an injector 72 in the supply reservoir 7, from which the air-powder mixture then arrives at the muzzle 5 of the gun 1 through the supply line 6. The actuation of the starting valve 76 can here result only through the depressing of a push-button 57 on the control device 30 or from an automatic control 300 of the control unit 30. The automatic control 300 will be described later in more detail. The motor control circuit 75 for control of the throttle valve 74 can be actuated by the push-button 27 of the gun 1 as well as by the automatic control 300.

The control unit 30 further includes a power supply circuit with a transformer 80, a voltage divider stage 81 connected to the output of the transformer 80 for supplying current to the motor, the automatic control, and a stabilization stage 82 for stabilizing the high voltage. Such circuit elements are generally known, and need not to be further described here. The switching-ON of the power is accomplished by the pressure switch 83. A similar switch 53 is of course provided also in the grip 2 of the gun 1.

The automatic control 300 includes switching circuits with display means 35, 37, 38 similar to the display means 15, 17, 18 of the gun 1 and the previously mentioned selector switches 45, 47, 48 for controlling the stepping motor 13 for the deflecting plate 9, the servo motor 73 for the throttle valve 74, and for regulating the voltage of the high voltage generator 4.

It is emphasized here that all the circuits as described thus far are preferably digital circuits, to permit adjustment with greatest accuracy in the shortest time. It is then also possible to have the adjustments be made manually with the mentioned pressure switches or by the automatic control as pre-set, with the adjusted values being displayed at the control device as well as at the gun.

It is further noted that the preselection switches 45, 47, 48 also can be shunted by punched card or magnetic tape control circuits, for which there is provided an auxiliary connection 90 on the control unit 30.

The preselector switches 45, 47, 48 are connected with impulse counters 46 and impulse generators 49 in such a manner that an impulse number can be set with the particular preselection switch, which impulse number then goes by way of the impulse generator-counter circuit 46, 49 to the adjustment elements and to the display means. The preselection switches are shunted for individual manual adjustment on the gun itself by the corresponding pressure switches 25, 26, 27 or the corresponding pressure switches 55 55*a*, 56, 57 of the control unit 30.

Thus, for the adjustment of the deflecting plate 9, the motor 13 can receive its adjustment impulses from the pressure switch 25 on the gun 1, or from the pressure switch 56 of the control unit 30, or from the preselection switch 48 through the appropriate impulse generator and impulse counter 49, 46 or from a memory through the connection 90. It is self-evident that the particular circuit design for such functions can be as desired, for which reason a more detailed description of such possible circuits is not given.

The quantity of sprayed powder can in a similar manner be regulated in various ways which result in the control of the throttle valve 74 through the pressure switches 26 or 55 or by the preselector switch 47 coupled to impulse generator 49 and pulse counter 46 or a remote memory connected to terminal 90.

For regulation of the high voltage, the pressure switch 27 on gun 1, the preselector switch 45, or the remote memory acts through a staircase voltage generator 54, which regulates the supply voltage for the converter of the converter-transformer circuit 14. The converter delivers a high frequency alternating current to the transformer, which itself then delivers a high voltage to the generator 4.

From the above-described, there thus results an apparatus for the electrostatic powder coating having a broad range of application and fulfilling all the conditions posed at present for such apparatus, especially those relating to a rapid and certain adjustment of all parameters without the necessity of halting therefore the operation of the apparatus.

Naturally, a number of modifications are conceivable. A single control unit could be designed for use with a plurality of powder spray guns. It is further possible to design the circuits of the control unit, as well as those of the powder spray gun, as replaceable printed circuits or circuit modules. Likewise, the powder spray gun may be suitably manufactured on a modular principle to permit rapid exchange of defective parts.

We claim:

1. A powder spray gun for electrostatic powder coating of a surface, said gun being of the type comprising:

a gun housing (1), including a muzzle (5);

a deflecting plate rod (8) coaxially disposed in said muzzle and extending out of the opening of said muzzle to form with said muzzle an annular powder channel, said rod being guided in said muzzle so that it is axially movable and having a threaded inner end portion;

a deflecting plate (9) fixed to the outer end of said rod;

electrodes (16) extending into said powder channel and electrically connected to a high voltage source, a servo-motor (13) positioned in said gun housing drive means (11) positioned coaxially with said muzzle coupling the servo-motor (13) to the threaded inner end portion of said deflecting plate rod (8) to change its axial position with respect to the muzzle;

said powder channel having a laterally offset inlet end remote from said deflector plate (9) and positioned between the powder channel and said servo-motor;

a powder supply line (6) connecting a powder supply reservoir (7) with said powder channel inlet end;

motor control circuit means (23) connected to said motor, and electrical circuits disposed inside said housing including a first manually operable electrical pressure switch located on the gun housing, and (25, 26, 27), connected to and controlling, said motor control circuit means and hence said motor to control, by operation of the switch on the gun, the position of the deflecting plate (9) in front of the muzzle;

at least one further switch located on the gun housing, connected to and controlling at least one of:

the voltage level of said high voltage source; the amount of powder entering said powder channel; and display means (15, 17, 18) located on said housing and displaying at least two of:

the position of the deflecting plate (9) with respect to the muzzle;

the level of high voltage connected to the electrodes (16);

the amount of powder supplied by the gun.

2. The gun defined in claim 1 and wherein said drive means comprises a hollow, internally threaded inner end portion of said rod (18) engaged by a threaded plug (11) connected to a shaft (12) of said servo-motor (13).

3. The gun defined in claim 2, and wherein said motor is a stepping motor (13).

4. The gun defined in claim 1, and wherein said motor is a stepping-motor (13).

5. The gun defined in claim 1, and wherein said electrical circuits are digital circuits.

6. The gun defined in claim 1 in combination with a remote control unit (30, 300) having controlled elements (45, 47, 48; 55, 56, 57; 83) providing at least the same control functions as those being switched by the manually operable electrical pressure switches (25, 26, 27) located on the gun housing;

further comprising a connecting cable (20) interconnecting the remote control unit and the gun housing, said electrical circuits disposed inside said gun housing being electrically connected in parallel with the control elements of the control unit to permit alternate control of the respective functioning either remotely, from the control units, or directly, on the gun, by manual operation of the respective pressure switches on the gun itself.

7. The gun defined in claim 1 wherein three manually operable electrical pressure switches are provided on the gun housing to control, respectively, said motor control circuit means to position the deflecting plate (19); the voltage level of said high voltage source, and hence the voltage of the electrodes (16); and the amount of powder entering said powder channel;

and the display means located on the housing display, respectively, at least the level of high voltage connected to the electrodes (6) and the amount of powder supplied through said powder channel.

8. The gun defined in claim 7 in combination with a remote control unit (30, 300) having controlled elements (45, 47, 48; 55, 56, 57; 83) providing at least the same control functions as those being switched by the manually operable electrical pressure switches (25, 26, 27) located on the gun housing;

further comprising a connecting cable (20) interconnecting the remote control unit and the gun housing, said electrical circuits disposed inside said gun housing being electrically connected in parallel with the control elements of the control unit to permit alternate control of the respective functioning either remotely, from the control units, or directly, on the gun, by manual operation of the respective pressure switches on the gun itself.

* * * * *